United States Patent [19]

Nuzzi et al.

[11] 4,222,778

[45] Sep. 16, 1980

[54] LIQUID SEEDERS FOR ELECTROLESS METAL DEPOSITION

[75] Inventors: Francis J. Nuzzi, Freeport; Daniel F. Vitellaro, Huntington Station, both of N.Y.

[73] Assignee: Kollmorgen Technologies Corporation, Dallas, Tex.

[21] Appl. No.: 25,546

[22] Filed: Mar. 30, 1979

Related U.S. Application Data

[60] Division of Ser. No. 770,063, Feb. 18, 1977, Pat. No. 4,160,050, which is a continuation of Ser. No. 676,527, Apr. 13, 1976, abandoned.

[51] Int. Cl.[3] ..... C23C 3/02

[52] U.S. Cl. ..... 106/1.11; 427/304; 427/306

[58] Field of Search ..... 106/1.11; 427/304, 305, 427/306

[56] References Cited

U.S. PATENT DOCUMENTS 4,020,197 4/1977 Steffen ..... 427/304

*Primary Examiner*—Ralph S. Kendall

*Attorney, Agent, or Firm*—Morgan, Finnegan, Pine, Foley & Lee

[57] ABSTRACT

Novel liquid seeders and catalyzation processes for the electroless deposition of metal on substrates. The seeders comprise the admixture of sources of cuprous, hydrogen and halogen ions, organic solvent(s), and an agent to convert cupric ions to cuprous ions. The processes include the steps of contacting a substrate with a certain seeder, fixing the seeder to the substrate with water, and catalyzing the fixed seeder by further water treatment, use of a strong reducing agent, or both.

14 Claims, No Drawings

LIQUID SEEDERS FOR ELECTROLESS METAL DEPOSITION

CROSS-REFERENCE TO RELATED APPLICATIONS

This is a division of Ser. No. 770,063, filed Feb. 18, 1977, U.S. Pat. No. 4,160,050, which, in turn, is a continuation of Ser. No. 676,527, filed Apr. 13, 1976, now abandoned.

The formation of an adherent layer of metal on a substrate by contacting the substrate with an electroless metal deposition bath requires that the substrate be first rendered catalytic to the deposition of electroless metal. Preferred state of the art methods of such catalysis include the utilization of noble, or precious, metals as catalyzing agents.

Precious metal catalyst systems for electroless metal deposition include sequential treatment of the substrate to be metal coated with, for example, a stannous chloride-containing solution and then a solution comprising palladium chloride. See, e.g., U.S. Pat. No. 3,425,946 to Emons, where the stannous solution also contains a solvent for a plastic substrate. Single-step precious metal catalysts, or seeders, are also known, such as the colloidal palladium metal/stannous chloride catalysts described in U.S. Pat. No. 3,011,920 to Shipley and the clear solution, complexed palladium chloride/stannous chloride seeders taught in U.S. Pat. Nos. 3,672,923; 3,672,938; and 3,682,671 to Zeblisky.

The expense of using precious metal catalysts in electroless metal deposition has resulted in efforts to utilize non-noble, or base, metal catalysts for the electroless deposition of metal.

In U.S. Pat. No. 3,347,724 to Schneble et al, resinous substrates having dispersed particles of base metal compounds, for example, copper oxide, are taught. The physically dispersed base metal compound is rendered catalytic to the deposition of electroless metal by contacting with a reducing agent.

In U.S. Pat. No. 3,524,754 to Blytas et al, a method of chemically utilizing certain base metal compositions as electroless metal deposition catalysts on thermoplastic substrates is disclosed. This process essentially consists of contacting a thermoplastic substrate with a solution of a copper or nickel salt in a solvent for the plastic; drying the treated substrate; contacting the substrate with a reducing agent to form elemental metal; rinsing away of the reducing agent; and electroless metal plating of the substrate. Preferred for use in this system are organic cuprous and cupric salts, although, for example, cuprous chloride is disclosed as having been successfully used on thermoplastics. When practicing the compositions and methods of Blytas et al, it is recommended that the metal salts and the solutions of same be handled in water-free environments. The drying step between the impregnation and reduction steps, for example, is preferably carried out in an inert atmosphere such as nitrogen.

In U.S. Pat. Nos. 3,772,056 and 3,772,078 to Polichette et al, reducible base metal salt compositions useful in catalyzation processes for electroless metal deposition are disclosed. The seeder compositions described include, for example, cupric chloride, an organic solvent such as dimethyl formamide, and an auxiliary reducing agent such as glycerine. Disclosed processes require that the treated substrate be dried after contacting with the seeder.

According to the present invention, compositions and processes utilizing copper as a catalyzing agent are described. When used in the prescribed fashion, copper-based seeders not only permit the practitioner to dispense with the intermediate step of drying in an inert atmosphere but permit elimination of the drying step altogether. Additionally, an optional method described herein also permits elimination of a separate reduction step.

In brief, the novel copper seeders of the invention comprise cuprous ions, hydrogen ions, halogen ions, at least one organic solvent and an agent for preventing the formation of, or minimizing or eliminating the presence of, cupric ions. The new process comprises treating a surface that is to be provided with a layer of electroless metal with a copper seeder containing an organic solvent, followed by contacting the treated surface with water in order to fix the catalytic agent on the surface and, if desired, further contacting with water to render the treated surface catalytic to the deposition of metal from an electroless metal deposition bath. Optionally, the treated surface may be elevated to a state of higher catalytic activity by contacting with a strong reducing agent, either immediately following fixation or after the fixed material has been rendered catalytic by water treatment.

The present invention permits the promotion of adhesion between the seeder and resinous substrates by including organic solvent in the seeder that will swell or dissolve the resinous substrate to be catalyzed to electroless metal deposition. Use of the present invention also permits thorough water rinsing between treating the substrate with the seeder and subsequent steps in the process. This latter aspect is particularly advantageous when the substrate to be metallized already includes metal-clad portions, since the result is a cleaner metal-clad surface following electroless metal deposition.

The novel seeders may be used with any type of surface that will withstand the necessary contacting with the liquid seeders, including, for example, such materials as glass and ceramics, thermoplastic resins and thermosetting resins, and laminates such as phenolic/-paper and epoxy/fiberglass. Seeders according to the invention comprise an admixture of cuprous ions, hydrogen ions, halogen ions, an agent for combating the presence or formation of cupric ions, and at least one organic solvent.

The cuprous ions are usually obtained through the inclusion of a cuprous salt that is soluble in the liquid medium of the seeder mixture. Preferred salts for this purpose are the cuprous halides, with cuprous chloride being especially preferred. Rather than starting with cuprous ions, one may begin with cupric ions and reduce them to the cuprous state.

Any sources of hydrogen ions or halogen ions that do not adversely affect operation of the other components of the admixture may be used. Chlorine is the preferred halogen and hydrochloric acid, as containing both hydrogen ions and chlorine ions, is a preferred source of both.

Cupric ions are undesirable as contituents of seeders according to the invention, and the seeders therefore incorporate an agent to convert cupric ions to cuprous. The cupric ions may originate with a cuprous salt, being an oxidation and disproportionation product of same and therefore present in the initial mixture, or may be formed in the liquid seeder itself. As noted above, cupric ions may be used as the initial source of the cuprous ions. Preferred agents for this function include reducing agents which, in the environment of the liquid seeder medium, are strong enough to reduce cupric ions to the cuprous state but are not so strong as to convert cuprous ions to elemental copper. Two especially preferred such agents are sodium hypophosphite and stannous chloride. The reasons for minimizing or eliminating the presence of cupric ions include the facts that cupric ions will be washed off the treated substrate in the fixing step, rather than retained, and that such ions have an etching action on elemental copper. This latter consideration is relevant in electroless metal deposition processes in the printed circuit industry, for example, which often include forming layers of electroless metal on a substrate that is already clad with a thin copper coating. It is therefore necessary that steps preceding the actual deposition of electroless metal, such as the catalysis of seeding step, not deleteriously affect the copper-clad portions of the substrate. This etching action is a particularly important consideration when the seeder solution includes water as a constituent.

The purpose of the organic solvent constituent(s) varies somewhat with the desired application of the liquid seeder being formed. If the seeder is being used basically for its catalyzation capability alone, then the primary purpose of the organic component is to act as a solvent for the copper salt and permit the generation of cuprous ions. If, however, the seeder is to be used to promote adhesion between the catalytic material and, for example, a resinous substrate, then another important function of the organic solvent, or at least one of them where the seeder incorporates two or more organic solvents, is to swell or attack the resinous substrate that is to be metallized. The preferred choice of solvent(s) will vary with the particular substrate being used and the application. For seeding thermosetting resinous laminates where adhesion promotion is desired, a very polar solvent such as dimethyl formamide is a preferred constituent. Where thermoplastic resins are to be so treated, such as acrylonitrile-butadiene-styrene polymers, lower chain alkyl glycols and glycol ethers, such as ethylene glycol, dipropylene glycol and ethylene glycol monoethyl ether are useful organic solvent constituents of the seeder.

Liquid copper seeders of the sort described are preferably utilized in the following fashion: At least the portion(s) of the substrate to be provided with a layer of electroless metal are contacted with a liquid seeder comprising the admixture of cuprous ions, halogen ions and at least one organic solvent. In preferred applications of the invention, the walls of through holes in printed circuit boards that are to be plated or surface portions of laminated substrates that are to be metallized are treated with the seeder. The work piece is then briefly (on the order of 30 seconds to one minute) contacted with water, resulting in the formation of a pre-catalytic coating over whatever surfaces were contacted with the catalyst solution. More precisely, the water treatment fixes the catalytic agent itself, which is still in a pre-catalytic state, to the substrate. Although the coating is here described as being in a pre-catalytic state, there is a continuum between no catalytic activity of the coating fixed on the treated surface and a very significent and useful amount of catalytic activity. Where the particular catalytic state of the coating falls on this continuum is directly related to the duration of the water treatment. It is highly likely that the fixed coating will have some catalytic activity although, as here indicated, after only brief water treatment the coated substrate will be essentially pre-catalytic. Following this step, the practitioner may follow one of three routes: further water treatment, or contacting with a reducing agent, or both.

Since the agent fixed on the treated substrate surface(s) by the initial water treatment is still in a pre-catalytic form, it must then be rendered catalytic to the deposition of metal from an electroless metal deposition bath. Water treatment for a period longer than that necessary to initially fix the catalytic agent to the substrate will result in the coating becoming catalytic to the deposition of electroless metal. When cuprous chloride is used in the seeder, for example, the initial fixed coating has a whitish appearance and is essentially non-catalytic. If the water treatment is extended to about five minutes, the coating evolves to a pale green color and is then catalytic to electroless metal deposition. The substrate may then be plated in an electroless metal deposition bath.

Alternatively, the substrate may be treated with a strong reducing agent immediately following the initial brief water treatment in order to render it catalytic. With a cuprous chloride-containing catalyst, the previously described whitish pre-catalytic coating turns gray or black following treatment with a strong reducing agent and is then catalytic to electroless metal deposition.

Still a third alternative is to prolong the initial water treatment past the point necessary to merely fix the pre-catalytic agent and then treat the substrate in a strong reducing agent.

"Strong reducing agent," as used herein, includes any reducing agent that will reduce cuprous ions to elemental copper without detrimental effect on the other process steps. Preferred strong reducing agents include the boranes and borohydrides in aqueous solution, such as dimethylamine borane and sodium borohydride. Aqueous solutions of hydrazine hydrate are also useful for this purpose.

The following examples illustrate various applications of the invention.

EXAMPLE I

A piece of acrylonitrile butadiene styrene (ABS) is cleaned by immersion in methanol and dried with high pressure air.

| A seeder liquid is prepared by admixing: | |
|---|---|
| Ethylene glycol monoethyl ether | 950 ml. |
| Dimethyl formamide | 75 ml. |
| HCl (37%) | 50 ml. |
| Sodium hypophosphite | 15 gm. |
| CuCl | 40 gm. |

The ABS is treated for ten minutes in the above seeder, rinsed for five minutes in running water, and plated in the following electroless copper bath:

| | |
|---|---|
| N,N,N',N'-tetrakis-(2-hydroxypropyl)-ethylenediamine | 0.058 moles/l. |
| Cupric sulfate pentahydrate | 0.036 moles/l. |
| Sodium hydroxide | 0.36 moles/l. |
| Formaldehyde | 0.27 moles/l. |
| Sodium cyanide | 0.0002 moles/l. |

-continued

| | |
|---|---|
| Wetting agent | 0.001 gm./l. |
| Deionized water | To make 1 liter |
| Temperature | 30°-34° C. |

The entire surface of the ABS is covered with an adherent layer of bright electrolessly deposited copper.

EXAMPLE II

As in Example I, except that after the five minute water rinse the ABS is treated with the following reducing agent:

| | |
|---|---|
| Dimethylamine borane | 1 gm. |
| Deionized water | 1000 ml. |

The ABS is then rinsed in running water for three minutes and plated in the electroless copper bath of Example I.

EXAMPLE III

A piece of copper-clad epoxy/fiberglass laminate with holes drilled through it is immersed for seven minutes in a liquid seeder formed by admixing:

| | |
|---|---|
| Ethylene glycol | 400 ml. |
| Dimethyl formamide | 400 ml. |
| HCl (37%) | 200 ml. |
| Deionized water | 200 ml. |
| CuCl | 80 gm. |
| Sodium hypophosphite | 20 gm. |

The laminate is then rinsed in running water for two minutes and then treated in the reducing agent of Example II for five minutes. Another water rinse for two minutes is followed by plating for thirty minutes in the electroless copper deposition bath of Example I. The surface and hole walls of the laminate are covered with adherent, bright electroless copper.

EXAMPLE IV

As in Example III, except that the catalyzing liquid used is formed by admixing:

| | |
|---|---|
| Dimethyl formamide | 500 ml. |
| Deionized water | 500 ml. |
| HCl (37%) | 200 ml. |
| CuCl | 80 gm. |
| Sodium hypophosphite | 20 gm. |

EXAMPLE V

As in Example III, except that the following liquid seeder components are used:

| | |
|---|---|
| Dipropylene glycol | 500 ml. |
| HCl (37%) | 150 ml. |
| Deionized water | 50 ml. |
| CuCl | 40 gm. |
| Sodium hypophosphite | 10 gm. |

EXAMPLES VI-IX

Examples II through V are repeated with the substitution of the following reducing agent for that of the other examples:

| | |
|---|---|
| Sodium borohydride | 1 gm. |
| NaOH | 1.5 gm. |
| Deionized water | 1000 ml. |

EXAMPLES X-XI

Examples I and II are repeated using the following electroless nickel plating bath in place of the electroless copper bath:

| | |
|---|---|
| $NiCl_2 \cdot 6H_2O$ | 30 gm./l. |
| Glycolic acid (70%) | 50 ml./l. |
| NaOH (50%) | 25 ml./l. |
| 2-Mercaptobenzothiazole | 4 mg./l. |
| Dimethylamineborane | 2.5 mg./l. |
| pH adjusted with NaOH to | 7 |
| Temperature | 20°-30° C. |

Depending on the precise nature of the resinous substrate to be metallized, some adjustment between seeder immersion time, particular solvent(s), or ratio of solvents where more than one is used in forming the catalyzing liquid, is necessary. Absent this tailoring, undesirable results such as bubbling of the electrolessly deposited metal may be encountered. The following examples demonstrate the need for adapting the particular seeder to the substrate to be metallized.

EXAMPLE XII p Phenolic/paper and epoxy/fiberglass laminates coated with an adhesive according to U.S. Pat. No. 3,625,758 (Beiresdorf Technicoll 801), pieces of ABS and drilled copper-clad epoxy/fiberglass laminate are treated for about one minute in a liquid seeder formed by admixing:

| | |
|---|---|
| Ethylene glycol monomethyl ether | 100 ml. |
| CuCl (technical grade) | 2.5 gm. |
| HCl (37%) | 2 ml. |

The samples are rinsed in running water for 1-2 minutes and treated for five minutes in a reducing agent comprising:

| | |
|---|---|
| Sodium borohydride | 1 gm. |
| NaOH | 1.5 gm. |
| Water | to make 1 liter |

After immersion in an electroless copper deposition bath, all pieces are covered with copper and the copper-clad surface is clean. The copper on the ABS and adhesive surfaces is bubbled in appearance, while the copper in the barrels of the holes in the copper-clad laminate is not.

EXAMPLES XIII-XVI

Pieces of expoxy/fiberglass laminates that were adhesive-coated as in Example XII and pieces of copper-clad epoxy/fiberglass laminates, all containing through-holes, were processed according to Example XII except that the adhesive-coated pieces were first treated in a standard chromic/sulfuric acid activation bath and liquid seeders according to the following were used:

(EXAMPLE XIII)

| | |
|---|---|
| CuCl | 30 gm./l. |
| Stannous chloride | 30 gm./l. |
| Dimethyl formamide | 600 ml./l. |
| HF (52%) | 100 ml./l. |
| Deionized Water | 300 ml./l. |

(EXAMPLE XIV)

| | |
|---|---|
| Dimethyl formamide | 600 ml./l. |
| Sodium hypophosphite | 20 gm./l. |
| HBr (47%) | 100 ml./l. |
| CuCl | 40 gm./l. |
| Deionized Water | 300 ml./l. |

(EXAMPLE XV)

| | |
|---|---|
| CuCl | 50 gm./l. |
| Dimethyl formamide | 500 ml./l. |
| HI (57%) | 200 ml./l. |
| Sodium hypophosphite | 20 gm./l. |
| Deionized Water | 300 ml./l. |

(EXAMPLE XVI)

| | |
|---|---|
| $CuBr_2$ | 30 gm./l. |
| Dimethyl formamide | 750 ml./l. |
| HI (57%) | 200 ml./l. |
| Sodium hypophosphite | 20 gm./l. |
| Deionized Water | 50 ml./l. |

The cuprous ions in this example were obtained from the reduction of the cupric ions by the sodium hypophosphite, as indicated by a color change of brown to light yellow in the solution.

The pieces treated in the liquid seeder of Example XIV gave the best results of the four seeders described above. The deposited copper of this example was uniform while small voids were detected in the plated copper of the remaining three examples.

The following examples illustrate the use of compositions in which halogen ions are contributed by halogen-containing salts and no halogen acid is used:

EXAMPLE XVII

A piece of clean acrylonitrile-butadiene-styrene (ABS) was immersed in the following seeder composition for ten minutes:

| | |
|---|---|
| Ethylene glycol monoethyl ether | 90 ml. |
| Dimethyl formamide | 7 ml. |
| $HNO_3$ (conc.) | 3 ml. |
| $SrCl_2 . 6H_2O$ | 10 gm. |
| CuCl | 3 gm. |

The immersion in the seeder composition was followed by a five minute water rinse. The ABS was then immersed for five minutes in an aqueous solution of 1 gm./l. $NaBH_4$ and 1.5 gm./l. NaOH and then rinsed in water for two minutes. Plating for 30 minutes in the electroless copper bath of Example I at about 28° C. yielded a bright copper coating over about 95 percent of the ABS surface with no blisters.

EXAMPLE XVIII

Both the surface and hole walls of a piece of copper-clad laminate with holes drilled in it were well-plated according to the following procedure: the laminate was first cleaned in an aqueous solution of ammonium persulfate, rinsed, dipped in 10 percent $H_2SO_4$, rinsed and then immersed for five minutes in the following seeder:

| | |
|---|---|
| Dimethyl formamide | 60 ml. |
| $H_2O$ | 40 ml. |
| $HNO_3$ (conc.) | 3 ml. |
| $CaCl_2 . 2H_2O$ | 8 gm. |
| CuCl | 4 gm. |

This was followed by:

(a) water rinsing for two minutes;

(b) six minutes immersion in an aqueous solution of 1 gm./l. $NaBH_4$ and 1.5 gm./l. NaOH; p1 (c) water rinsing for two minutes; and (d) copper plating according to Example XVII for 20 minutes.

EXAMPLE XIX

A piece of clean ABS was immersed for thirty minutes with mixing in a seeder composition containing a reducing agent, formed by admixing:

| | |
|---|---|
| Ethylene glycol monoethyl ether | 90 ml. |
| Dimethyl formamide | 10 ml. |
| Tartaric acid | 10 gm. |
| $SrCl_2 . 6H_2O$ | 10 gm. |
| CuCl | 3 gm. |
| $SnCl_2$ | 1.5 gm. |

(Prior to use, the seeder was filtered through Whatman No. 4 filter paper.)

The ABS was then water-rinsed for two minutes, immersed with mixing in the reducing solution of $NaBH_4$ described in Example XVII for six minutes, water-rinsed again for two minutes, and electrolessly plated, with mixing for 25 minutes according to the plating procedure of Example I. The result was that 99% of the ABS surface was covered with bright copper, with no blisters.

When no halogen acid is used, the preferred halogen salts include those of strontium and calcium, with the chlorides of these metals being especially preferred. Preferred sources of hydrogen ions under these conditions include nitric acid and tartaric acid.

It will be noted from the preceding examples that the described invention may be used in a variety of electroless metal deposition processes. Thus a wide variety of substrates may be used; if the substrates are of a resinous nature, they may be activated in known ways to increase adhesion or adhesion promotion resulting solely from the organic solvent-containing seeders may be sufficient, especially where through holes are to be electrolessly metallized; and the invention permits thorough water rinsing of workpieces following the treatment of the substrate with the liquid seeder.

We claim:

1. A liquid seeder for the catalyzation of a substrate to the electroless deposition of metal, said liquid seeder comprising the admixture of:

(a) a source of cuprous ions;

(b) a source of hydrogen ions;
(c) a source of halogen ions;
(d) at least one organic solvent for said source of cuprous ions, said solvent being present in at least an amount sufficient to solubilize said source of cuprous ions; and
(e) a reducing agent capable of reducing cupric ions to cuprous ions, but incapable of reducing cuprous ions to elemental copper in the environment of said admixture.

2. A liquid seeder according to claim 1, wherein said halogen includes chlorine.

3. A liquid seeder according to claim 1, wherein component (a) is cuprous chloride.

4. A liquid seeder according to claim 1, wherein component (b) is hydrochloric acid.

5. A liquid seeder according to claim 1, wherein component (c) comprises cuprous chloride and hydrochloric acid.

6. A liquid seeder according to claim 1, wherein component (c) comprises only halogen-containing salts.

7. A liquid seeder according to claim 6, wherein component (c) comprises at least one member of the group consisting of the halogen salts of strontium and calcium.

8. A liquid seeder according to claim 7, wherein component (c) comprises at least one member of the group consisting of strontium chloride and calcium chloride.

9. A liquid seeder according to claim 8, wherein component (b) comprises only non-halogen acids.

10. A liquid seeder according to claim 1, wherein component (b) comprises only non-halogen acids.

11. A liquid seeder according to claim 10, wherein component (b) comprises at least one member of the group consisting of nitric acid and tartaric acid.

12. A liquid seeder according to claim 1, wherein component (d) comprises at least one member of the group consisting of lower chain alkyl glycols and glycol ethers and dimethyl formamide.

13. A liquid seeder acording to claim 1, wherein component (e) comprises at least one member of the group consisting of sodium hyphphosphite and stannous chloride.

14. A liquid seeder for the catalyzation of a substrate to the electroless deposition of metal, said liquid seeder comprising the admixture of:
(a) cuprous chloride;
(b) hydrochloric acid;
(c) at least one member of the group consisting of lower chain alkyl glycols and glycol ethers and dimethyl formamide, said material being present in an amount at least sufficient to solubilize said cuprous chloride; and
(d) at least one member of the group consisting of sodium hypophosphite and stannous chloride.

* * * * *